United States Patent [19]

Melgers

[11] Patent Number: 5,054,404

[45] Date of Patent: Oct. 8, 1991

[54] SHOWROOM FURNITURE CONSTRUCTION SYSTEM

[76] Inventor: George Melgers, Postbus 50068, 1305 AB Almere, Netherlands

[21] Appl. No.: 328,100

[22] PCT Filed: May 24, 1988

[86] PCT No.: PCT/NL88/00025

§ 371 Date: Jan. 18, 1989

§ 102(e) Date: Jan. 18, 1989

[87] PCT Pub. No.: WO88/09137

PCT Pub. Date: Dec. 1, 1988

[30] Foreign Application Priority Data

May 22, 1987 [NL] Netherlands ..... 8701224

[51] Int. Cl.[5] ..... A47B 9/00

[52] U.S. Cl. ..... 108/108; 108/107; 211/193

[58] Field of Search ..... 108/107, 110, 111, 108, 108/109, 144; 211/187, 193, 191, 208; 248/243

[56] References Cited

U.S. PATENT DOCUMENTS 1,324,537 12/1919 Belcher ..... 108/108
2,872,144 2/1959 Hobson .
4,127,929 12/1978 Zapara .

FOREIGN PATENT DOCUMENTS 0051889 5/1982 European Pat. Off. .
0130177 4/1902 Fed. Rep. of Germany ..... 108/110
2064579 7/1971 France .
2256011 7/1975 France .
0055222 4/1943 Netherlands .
0302107 12/1954 Switzerland .

OTHER PUBLICATIONS

Lundquists Monterbara Träkonstruktioner; Brunkerbergstorg 9, Stockholm, 1949; 108/111.

*Primary Examiner*—Kenneth J. Dorner
*Assistant Examiner*—Gerald A. Anderson
*Attorney, Agent, or Firm*—Edmund M. Jaskiewicz

[57] ABSTRACT

Showroom furniture construction system, composed of: a in mounted situation vertical stand, consisting of two vertical profile beams (1), which, on the top and bottom, are connected by cross beams (2), whereby the two vertical profile beams (1) are fitted with a groove (3) in longitudinal direction, in the bottom of which at desired distances a number of pin holes (4) is fixed: distance blocks (6) of which the pins (5) fit into the holes (4) of the groove (3): place-tray at one side and at one end fitted with protruding pins or pin holes (9): place-tray (8) supporting beams (12), at the top fitted with pin holes of protruding pins (10): place-tray supports (11), at one end fitted with two protruding pins (10) at the side planes and the bottom of the side planes fitted with a rectangular recess: vertical, compound supporting beam, at the inner surfaces of two parallel vertical beams, fitted with grooves at regular distances and starting from the long sides: locking blocks (13), fitted with protruding pins at teo parallel sides planes and composing parts.

6 Claims, 4 Drawing Sheets

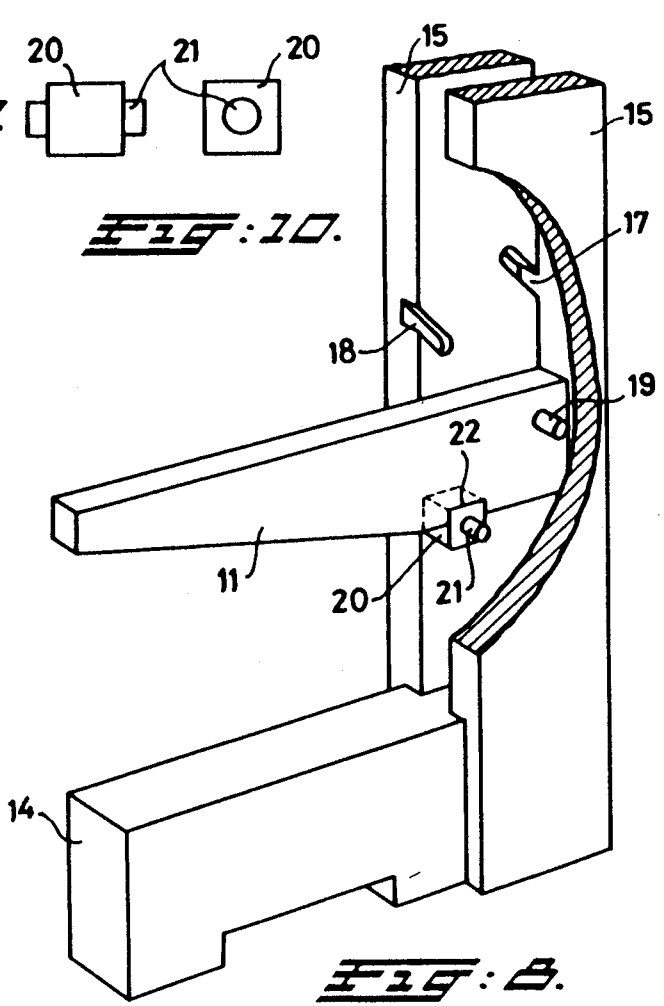
FIG. 8.
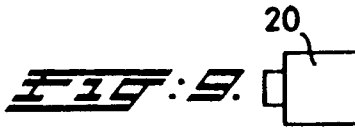
FIG. 9.
FIG. 10.
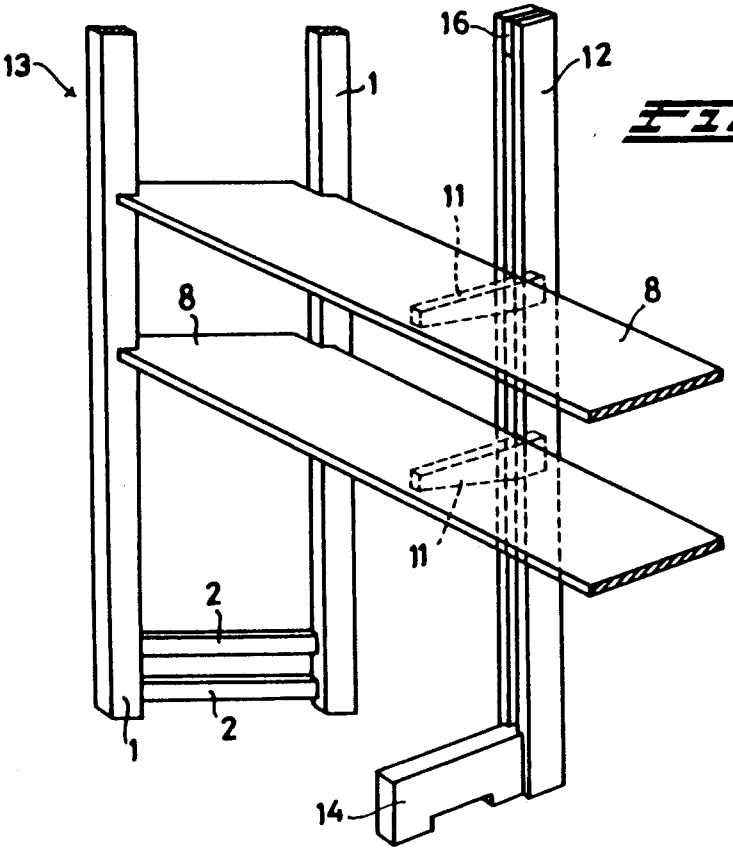
FIG. 7.

SHOWROOM FURNITURE CONSTRUCTION SYSTEM

FIELD OF THE INVENTION

This invention pertains to a variable showroom furniture construction system and more in particular to a wooden dismountable and remountable, variable showroom furniture construction system that, in mounted condition, consists at least of two vertical stands and a number of trays which in mounted condition, are lying horizontally, and are adjustable in height, said trays being carried on their outer ends by adjustable supporting beams attached to the stands.

BACKGROUND OF THE INVENTION

Until the present a number of different such-like construction systems have been proposed. These on the one hand have the disadvantage that for mounting use is made of esthetically unsightly metal mounting parts and/or series of bore holes clearly visible from the outside. As a result the mounted system is less suited to be applied for a true furniture function. On the other hand such systems are composed of interconnected components often showing an insufficient sturdy construction which in the long run proves not to endure the normally occurring heavy load. Consequently up till now a sufficiently sturdy mounted system could only be realized by means of a rather complicated and elaborate mounting equipment.

Subsequently there is a demand for a simple and financially attractive to manufacture proposal for a predominantly wooden showroom furniture construction system which is easy to mount and to dismount, which moreover is truly acceptable from an esthetic point of view as a piece of furniture thanks to the lack of visible unsightly metal parts and/or series of bore holes.

SUMMARY OF THE INVENTION

The purpose of my invention is therefore to provide a financially attractive variable showroom furniture construction system, that is easy to mount and to dismount and which meets the demand described hereabove.

The predominantly wooden showroom furniture construction system according to my invention is novel in that each column is provided on the inward facing side with a groove in the longitudinal direction, in the bottom of which a number of mutually spaced pin holes have been made into which pins of distance blocks fit, whereby each time on two opposite distance blocks attached at similar height, a supporting beam is positioned, on which one end of a tray rests, whereby each supporting beam is provided on the side directed to the thereupon resting tray, with recessed pin holes or protruding pins, while in the surface of the tray in the place of these pin holes or protruding pins respectively corresponding fitting pins or pin holes are provided, while an other portion of the pertaining tray rests on a console, removably attached on one end to a vertical compound column standing on one of the longitudinal sides of the tray , said column consisting of two spaced parallel poles on the top and bottom side kept together by a spacer, the inner surface of the two poles comprising a first set of spaced parallel grooves at one longitudinal edge of said poles, at well as a second set of spaced parallel grooves at the opposite longitudinal edge of said poles, whereby each console is provided with protruding pins projecting from both sides on the attached end of the console, said pins engaging the first set of grooves in both poles of the column, locking blocks being provided in the space between two poles of a compound column, said blocks having projecting pins at two opposite faces, engaging the second set of grooves in both poles of the column, said blocks cooperating with the attached end of a console.

DESCRIPTION OF THE DRAWINGS

FIG. 1 shows in perspective the upper portion of a stand, comprising two profiled columns and one end of a tray.

Figure 6:
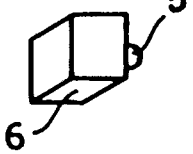
Figure 5:
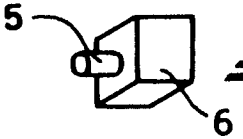

The FIGS. 5 and 6 show two opposite distance blocks for carrying a supporting beam.

Figure 7:
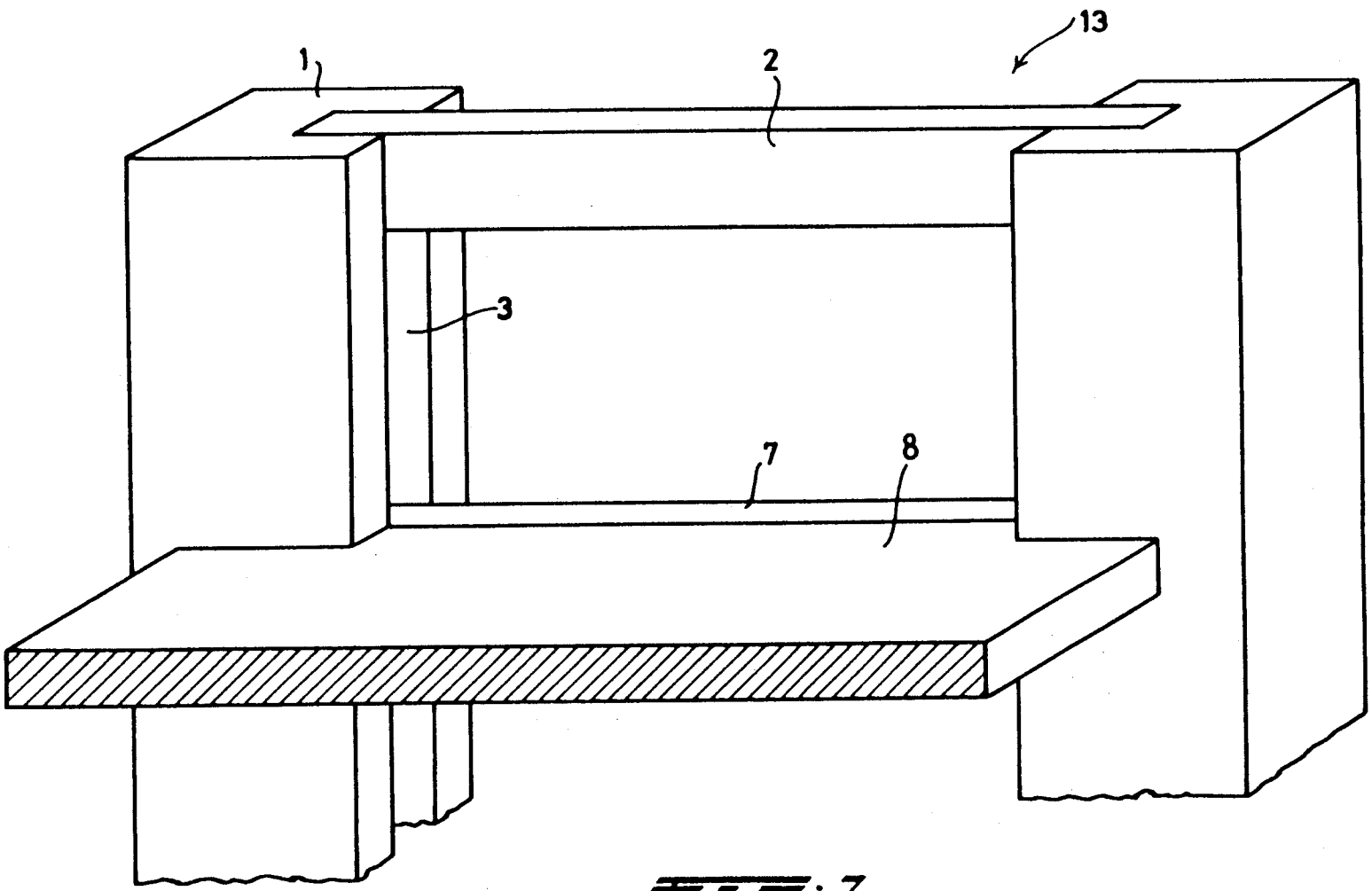

FIG. 7 is a perspective view of a showroom furniture.

FIG. 8 shows an enlarged detail from FIG. 7 with a partly cut-out portion.

The FIGS. 9 and 10 are two views of a locking block.

DESCRIPTION OF PREFERRED EMBODIMENTS

Figure 2:
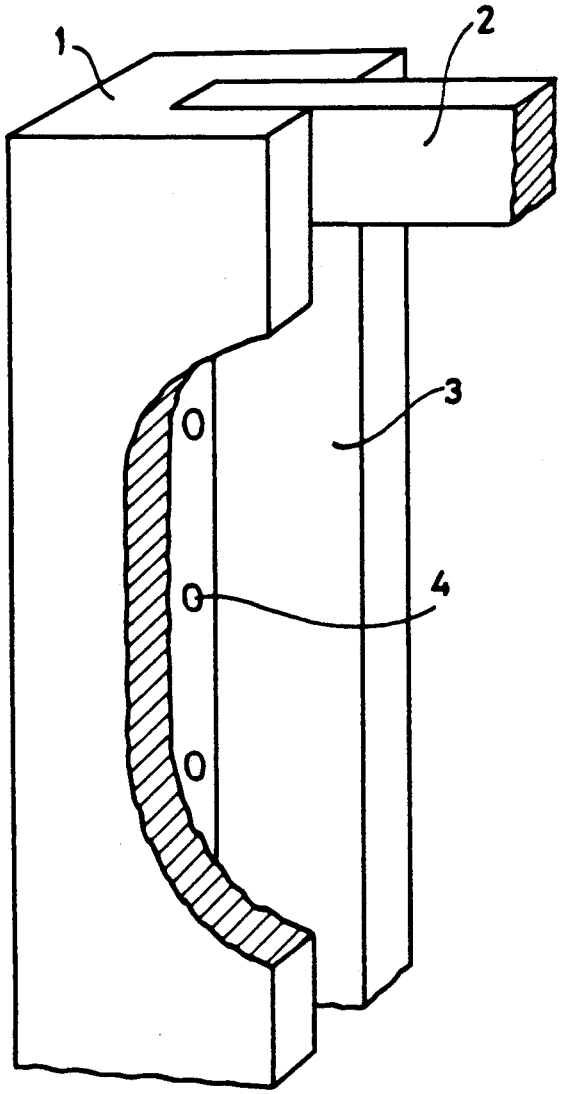
FIG. 2 is a view of the upper portion of one column, partly cut-out.

As can be seen from FIG. 1, a stand 13 for the present showroom furniture construction system is composed of two spaced profile columns 1, interconnected at the top by a cross-beam 2. At the invisible bottom of the stand 13, there is another cross-beam. Each column 1 has a longitudinal groove 3 into which the cross-beams 2 are secured. FIG. 2 shows a number of spaced holes 4 in the bottom of the groove 3. Into these holes 4 a pin 5 of a distance block 6 (shown in FIGS. 5 and 6) may be inserted. Upon a pair of blocks 6 mounted into the grooves 3 of two spaced columns 1 belonging to the same stand 13, both blocks lying on the same level, a supporting beam 7 can be laid, for carrying one end of a tray 8.

The width of the groove 3 in the inner side of each vertical profile beam 1 of the stand 13 must correspond as closely as possible to the width of the distance blocks 6 in order to give a mounted showroom furniture construction system the maximum sturdiness. The end of each tray 8 has on its underside two protruding pins 10 to fit into corresponding pin holes or recesses 9 in the upper surface of a wing 23 (FIG. 3 and 4) secured to the lower face of the supporting beam 7. The design also covers an embodiment in which the underside on one end of the tray 8 is provided with the holes or recesses 9 into which corresponding protruding pins 10 fit, projecting from the upper side of the wing 23.

Figure 3:
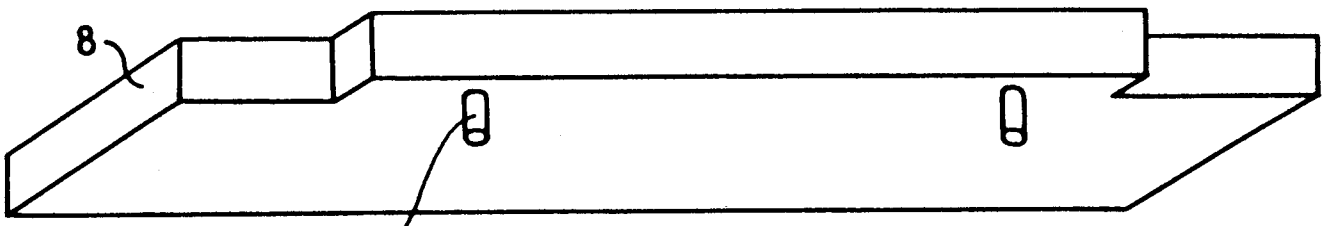
FIG. 3 is a perspective front view of a portion of a tray.
Figure 4:
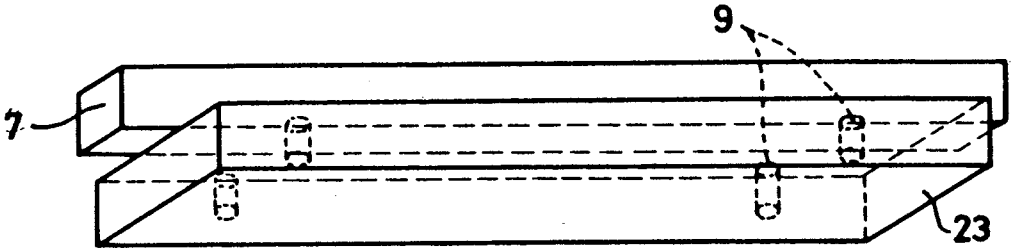
FIG. 4 shows a supporting beam with a separate wing-shaped sideward extension.

In a preferred design of the showroom furniture construction system according to the invention, the wing 23 is preferably so much lower than the upper surface of the beam 7, that in mounted condition the upper side of the trays 8 and the upper surface of the central part of the beam 7 are lying flush, as shown in FIG. 1, 3 and 4.

For a maximum strength of the assembled showroom furniture construction system subsequent the invention, the space between the poles 15 of the compound column 12 should be small and be preferably equal to the thickness of the consoles 11. The mutual distance between the parallel grooves 17 and 18 respectively in the inside surfaces of the compound column 12, said grooves starting from one of the longitudinal edges of the poles 13, can in principle vary in a large extent, depending on the specific application, or else the nature of the products to be displayed. The distance shall be at least 10 cm, while the length of the downward sloping grooves can vary from 10–20 mm.

The recess 22 on the underside of the console 11 in which the locking block 20 fits, shall preferably be rectangular in shape, with dimensions of the respective width and depth varying from 10–20 m, depending on the desired dimensions for the locking block 20, whereby the width is preferably greater than the depth. The protruding pins 19 on both sides of the console 11 and the pins 21 on both sides of the locking block 20 shall preferably consist of a cylindrical rod with a length of 3–10 mm and a diameter of at least 6 mm. The pins shall preferably be manufactured of a chosen metal, with sufficient strength and bending resistance.

According to a preferred design form of the showroom furniture construction system, the trays 8 are made thus that their longitudinal axis is at an angle of 50–70 degrees to the plane of the two vertical profile columns 1 of the stand 13 on the pertaining outer end of the tray. This angle will preferably be approx. 60 degrees in connection with the clear visibility of the objects on display. The end of the other portion of the tray 8 resting on the console 11 has a preferably rectangular shape and can have dimensions, which vary considerably, depending on their special designation. In general the width of a tray 8 shall vary from 20–40 cm and preferably from 30–35 cm, while the usually applied length shall lie between 70–140 cm and preferably between 90–110 cm.

According to a further preferred design, the component vertical compound column 12 is provided on the lower end with a fixed foot beam 14 which is oriented perpendicularly to the column 12 and in the same direction as that of the consoles 11 lying thereabove. Suitably the outer end of the foot beam 14 also forms the spacer 16 between the vertical parallel poles 15. The height of the foot beam 14 is preferably 10–15 cm. Preferably the lowest tray 8 is placed on the upper surface of the foot beam 14.

For the purpose of a maximum strength of the mounted showroom furniture system, the clearance between the poles 15 of the column 12 and the locking block 20 should be as small as possible, on the other hand it should leave sufficient space for the easy insertion and removal of said blocks.

The locking blocks 20 can also be manufactured of different suitable, form retaining materials with low thermal expansion, such as certain selected suitable plastics or wood. Preferably the locking blocks are made of wood, whereby the fibre direction of the wood must be perpendicular to the wood fibre direction of the console 11.

It will be evident that the component elements of the showroom furniture construction system according to the invention, can be manufactured very simply and quickly, and in large series, and therefore in a financially attractive manner with the aid of suitable equipment for such purpose. The showroom furniture construction system under consideration presents the following other advantages individually and in combination:

a. from the outside only wood is visible on the mounted showcase system, thus offering an important advantage from an esthetical point of view;

b. as a result of the suggested manner of assembly, which is relatively fast and easy, a sturdy construction is realized;

c. thanks to easy mounting and dismounting the arrangement of the desired showroom furniture construction system is simple to alter according to wish, depending on the ever changing user requirements;

d. because of the great variation possibilities with regard to the dimensions of the component parts, the showroom furniture construction system is greatly variable in height and width.

The invention also pertains to the characteristic separate parts of the showroom furniture construction system described above, and more in particular to the stands 13, comprising the vertical profile columns 1, the distance blocks 6, the supporting beams 7, the trays 8 with pins 10, the consoles 11, the vertical compound column 12 and the locking blocks 20. It will be evident that these parts and more in particular the stand 13, the trays 8, supporting beams 7 and consoles 11 and the vertical compound columns 12 can be manufactured from a great variety of common furniture woods or combinations thereof, whereby these parts can be veneered or varnished with colour varnish or with wood grain pattern accentuated varnish.

What is claimed is:

1. A showroom furniture construction system comprising a vertical stand having top and bottom ends and comprising a pair of spaced vertical profile columns, cross beams connecting said top and bottom ends of said spaced vertical profile columns, a horizontal supporting beam mounted to said vertical stand, a shelf having one end thereof supported upon said horizontal supporting beam, a vertical supporting beam spaced from said vertical stand and comprising a pair of spaced parallel strips each having top and bottom portions, said parallel strips each having a first and a second longitudinal edges and facing inner surfaces and a spacer block at each of said top and bottom portions interconnecting said inner surfaces thereof, there being a plurality of first opposed downwardly sloping grooves in said inner faces of said strips starting from said first longitudinal edges and a plurality of second opposed upwardly sloping grooves in said inner surfaces of said strips starting from said second longitudinal edges, a bracket extending horizontally from between said parallel strips of said vertical supporting beam for supporting thereon a portion of said shelf and having opposed vertical faces and an underside, a pair of pins extending laterally from said opposed vertical faces of said bracket and received within a pair of said opposed second grooves, there being a recess in said underside of said bracket and a locking block received within said recess, and a pair of second pins extending from opposed faces of said locking block and received within a pair of said opposed first grooves.

2. A showroom furniture construction system as claimed in claim 1 wherein successive grooves of each of said pluralities of first and second grooves being spaced at least 10 cm apart.

3. A showroom furniture construction system as claimed in claim 1 wherein said first and second grooves extend over only a portion of a said inner face of each said strip from a respective longitudinal edge thereof.

4. A showroom furniture construction system as claimed in claim 3 wherein each of said first and second grooves have a length of 10–20 mm.

5. A showroom furniture construction system as claimed in claim 1 wherein said shelf has a central longitudinal axis disposed at an angle of 50–70 degs. with respect to a plane passing through said pair of spaced vertical profile columns of said vertical stand.

6. A showroom furniture construction system as claimed in claim 1 and further comprising a foot beam extending horizontally from the bottom portion of said vertical supporting beam in the same direction as said bracket and disposed at substantially a right angle to said vertical supporting beam, said bottom portion spacer block interconnecting the bottom portions of parallel strips comprising an end portion of said foot beam.

* * * * *